US006461251B1

(12) United States Patent
Yamagishi et al.

(10) Patent No.: US 6,461,251 B1
(45) Date of Patent: Oct. 8, 2002

(54) SOLID GOLF BALL

(75) Inventors: Hisashi Yamagishi, Chichibu (JP); Takashi Maruko, Chichibu (JP); Yutaka Masutani, Chichibu (JP)

(73) Assignee: Bridgestone Sports Co, Ltd., Tokyo (JP)

( * ) Notice: Subject to any disclaimer, the term of this patent is extended or adjusted under 35 U.S.C. 154(b) by 0 days.

(21) Appl. No.: 09/487,779

(22) Filed: Jan. 20, 2000

(30) Foreign Application Priority Data

Jul. 22, 1999 (JP) ..... 11-207332

(51) Int. Cl.[7] ..... A63B 37/06
(52) U.S. Cl. ..... 473/376
(58) Field of Search ..... 473/376, 373, 473/378, 371, 377, 374, 367, 368, 369

(56) References Cited

U.S. PATENT DOCUMENTS 5,688,595 A * 11/1997 Yamagishi et al. ..... 473/375
5,725,442 A * 3/1998 Higuchi et al. ..... 473/376
5,980,396 A * 11/1999 Moriyama et al. ..... 473/376

FOREIGN PATENT DOCUMENTS

| | | | |
|---|---|---|---|
| JP | 8-336617 | 12/1996 | ..... A63B/37/00 |
| JP | 9-56848 | 3/1997 | ..... A63B/37/00 |
| JP | 9-299510 | 11/1997 | ..... A63B/37/00 |
| JP | 10-328328 | 12/1998 | ..... A63B/37/00 |
| JP | 11-47309 | 2/1999 | ..... A63B/37/00 |

* cited by examiner

*Primary Examiner*—Mark S. Graham
*Assistant Examiner*—Reann Gordon
(74) *Attorney, Agent, or Firm*—Sughrue Mion, PLLC

(57) ABSTRACT

In a solid golf ball of four or multi-layer construction, comprising a center core, an outer core, an intermediate layer, and a cover, the outer core has a higher Shore D hardness than the center core, and the solid core has a diameter of up to 27 mm. The ball has improved feel, click, durability and flight performance.

17 Claims, 1 Drawing Sheet

SOLID GOLF BALL

This invention relates to a solid golf ball having satisfactory sensory characteristics (e.g., feel and click) as well as improved durability and flight performance.

BACKGROUND OF THE INVENTION

For a choice of golf balls, sensory reactions of the ball when hit including an adequately soft feel and an agreeable click are now regarded important. As is known in the art, upon driver or similar shots causing substantial deformation of the ball, the player feels the hardness of an internal region of the ball approximate to its center. A variety of proposals of constructing the golf ball from multiple layers were made for improving the sensory reactions as described, for example, in JP-A 8-336617, 9-56848, 9-299510, 10-328328, and 11-47309. Many of these proposals, however, relate to cores or center spheres having a relatively large diameter of greater than 35 mm and even at minimum, a diameter of roughly 30 mm. They are not necessarily effective for improving feel.

It was also proposed to form a relatively soft center core to a small diameter and enclose the small diameter center core with a hard layer (enclosure or outer core). In this proposal, the outer core is naturally made thick. However, enclosing a soft center core with a hard outer layer substantially results in a core having a large outer diameter. In the region where the ball undergoes substantial deformation, for example, at the time of driver shots, the player feels the hardness of the enclosure or outer core, which feel sometimes becomes hard. If the outer core is too thick, the ball becomes less durable due to the difference in hardness between the center and outer cores.

SUMMARY OF THE INVENTION

An object of the invention is to provide a novel and improved golf ball having satisfactory sensory characteristics when hit including a soft feel and an agreeable click as well as improved durability and distance performance.

The invention provides a solid golf ball of multilayer construction of at least four layers, comprising a solid core consisting of a center core and an outer core around the center core, an intermediate layer of at least one layer enclosing the solid core, and a cover enclosing the intermediate layer. The outer core has a higher Shore D hardness than the center core. The solid core has a diameter of up to 27 mm. Then the golf ball has satisfactory sensory reactions upon impact including a soft feel and an agreeable click. Additionally, the ball is fully durable and travels a satisfactory distance.

Preferably, the outer core is formed of a thermoplastic resin base composition. Preferably, the Shore D hardness of the outer core is from 55 to 85 and is at least 5 units higher than the Shore D hardness of the center core. At least one layer of the intermediate layer preferably has a lower Shore D hardness than the outer core. In one preferred embodiment, the intermediate layer closely encloses the surface of the solid core, is formed of a resin base composition, and has a Shore D hardness which is at least 2 units higher than the Shore D hardness of the center core.

The Shore D hardness as used herein is measured according to ASTM D-2240.

DESCRIPTION OF THE PREFERRED EMBODIMENTS

Figure 1:
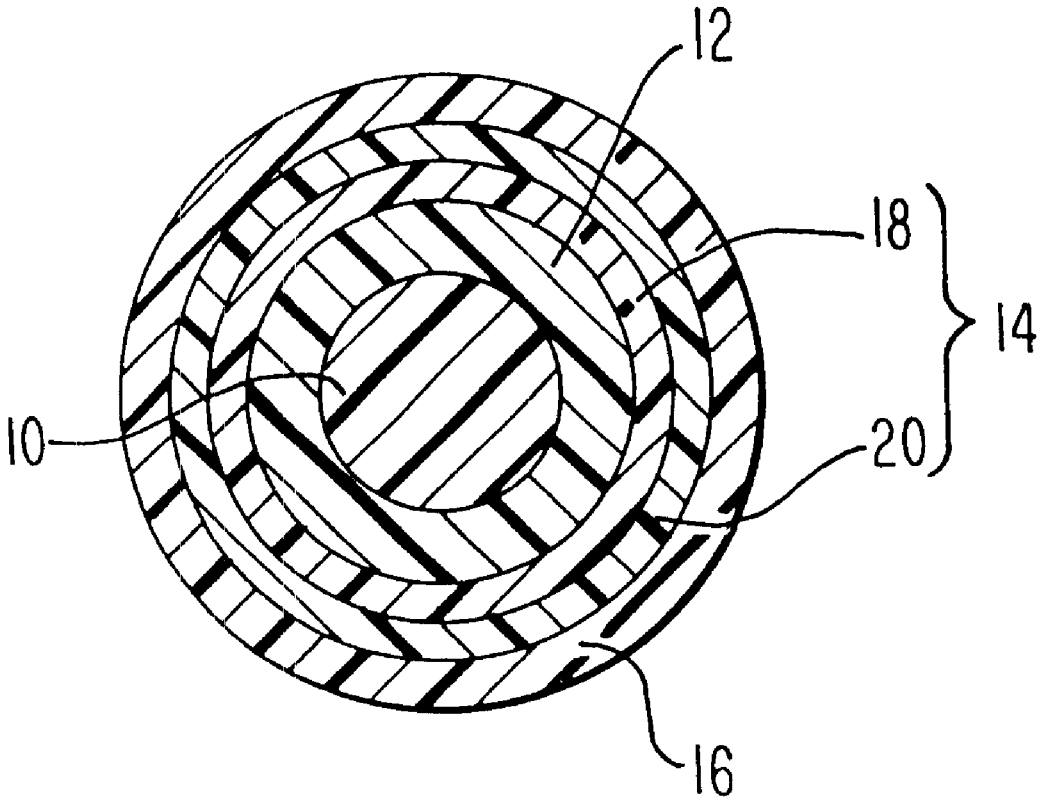
FIG. 1 is a schematic cross-section of one exemplary multi-piece solid golf ball according to the invention.

The solid golf ball of the invention has a multilayer construction of at least four concentric layers. Specifically, the ball includes a solid core including a center core 10 and an outer core 12 around the center core 10, an intermediate layer 14 of at least one layer enclosing the solid core, and a cover 16 enclosing the intermediate layer 14. The intermediate layer 14 may include at least a first intermediate layer 18 and a second intermediate layer 20. Specifically the ball includes a solid core consisting of a center core and an outer core around the center core, an intermediate layer of at least one layer enclosing the solid core, and a cover enclosing the intermediate layer.

The center core is a center sphere of the ball and may be formed of a composition primarily comprising a thermoplastic resin or rubber.

The thermoplastic resins used herein include well known ones, for example, polyamide resins, ionomer resins, polyester resins, polycarbonate resins, polyarylate resins, ABS resins, and mixtures thereof. These resins are commercially available under the trade name of Surlyn (ionomer resins) from E. I. DuPont, Himilan (ionomer resins) from Dupont-Mitsui Polychemical Co., Ltd., Hytrel (polyester resins) from Dupont-Toray Co., Ltd., Rilsan BMNO (polyamide resins) from Dupont-Toray Co., Ltd., U Polymer (polyarylate resins) from Unitika, Ltd., UBE Nylon (polyamide resins) from Ube Kosan Co., Ltd., and Pandex (polyurethane resins) from Dai-Nippon Ink & Chemicals Co., Ltd.

In the thermoplastic resins, inorganic fillers such as barium sulfate, titanium dioxide and zinc oxide may be blended as a weight modifier.

Where the center core is formed of the thermoplastic resins, injection molding or similar molding techniques may be used, with optimum molding conditions being selected in accordance with a particular formulation.

In the other embodiment where the center core is formed of rubber, a rubber composition comprising polybutadiene as the base rubber is appropriate. The use of cis-1,4-polybutadiene having a cis structure of at least 40% is especially suitable. Where desired, other suitable rubber ingredients such as natural rubber, polyisoprene rubber or styrene-butadiene rubber may be compounded with the polybutadiene to give the base rubber. Up to about 10 parts by weight of the other rubber ingredients may be compounded per 100 parts by weight of the polybutadiene.

A crosslinking agent may be included in the rubber composition. Exemplary crosslinking agents are the zinc and magnesium salts of unsaturated fatty acids such as methacrylic acid and acrylic acid, and ester compounds such as trimethylpropane methacrylate. Zinc diacrylate is especially preferred for achieving a high resilience. The crosslinking agent is preferably included in an amount of about 10 to 40 parts by weight per 100 parts by weight of the base rubber.

A vulcanizing agent is generally compounded in the rubber composition. Organic peroxides are preferred vulcanizing agents. Examples of suitable peroxides include commercially available products such as Perhexa 3M (manufactured by Nippon Oils and Fats Co., Ltd.). The amount of vulcanizing agent included in the rubber composition is preferably from about 0.6 to 2 parts by weight per 100 parts by weight of the base rubber.

If necessary, other suitable ingredients may also be blended in the rubber composition, such as antioxidants and specific gravity-modifying fillers (e.g., zinc oxide, barium sulfate). The amount of such specific gravity modifiers blended is typically more than about 0.5 parts, especially more than about 1 part and less than about 30 parts by weight per 100 parts by weight of the base rubber.

Where the center core is formed from the rubber composition, the composition may be molded and vulcanized by a conventional procedure, for example, under conditions of 155° C. and 20 minutes.

It is recommended that the center core is formed to a diameter of at least 3 mm, preferably at least 5 mm, more preferably at least 7 mm and up to 25 mm, preferably up to 24 mm, more preferably up to 23 mm. A center core with too small a diameter may be ineffective whereas too large a diameter may lead to a hard feel and a loss of durability.

The center core preferably has a Shore D hardness of at least 10, especially at least 15 and up to 55, especially up to 50, though not limited thereto.

Next, the outer core enclosing the center core may be composed mainly of a resinous material or a rubber base composition. Especially for imparting agreeable sensory characteristics to the ball, the use of resinous materials is preferred. Use may be made of the thermoplastic resins listed above in conjunction with the center core. Included are polyamide resins, ionomer resins, polyester resins, polycarbonate resins, polyarylate resins, ABS resins, and mixtures thereof. These resins are commercially available under the trade name of Surlyn (ionomer resins) from E. I. DuPont, Himilan (ionomer resins) from Dupont-Mitsui Polychemical Co., Ltd., Hytrel (polyester resins) from Dupont-Toray Co., Ltd., Rilsan BMNO (polyamide resins) from Dupont-Toray Co., Ltd., U Polymer (polyarylate resins) from Unitika, Ltd., UBE Nylon (polyamide resins) from Ube Kosan Co., Ltd., and Pandex (polyurethane resins) from Dai-Nippon Ink & Chemicals Co., Ltd.

The outer core is formed on the surface of the center core by an injection molding process of placing the center core in a mold and injection molding the resinous material around the center core. An alternative is a compression molding process involving forming thermoplastic resin sheets into a pair of hemispherical cups, placing the center core in one cup, closing the other cup over the center core, and effecting molding under heat and pressure.

Where the rubber composition is used in the outer core, a polybutadiene base rubber composition as described for the center core may be used as well. In forming the outer core from the rubber composition, one suitable method is a two-step process in which the rubber composition is first subjected to primary vulcanization (semi-vulcanization) in a mold to form a pair of hemispherical cups. A preformed center core is then placed in one of the hemispherical cups, the other cup is closed over the center core, and secondary vulcanization (complete vulcanization) is carried out.

According to the invention, the Shore D hardness of the outer core should be higher than the Shore D hardness of the center core. An appropriate hardness difference is at least 5 units, preferably at least 10 units, more preferably at least 18 units in Shore D hardness. By establishing such a hardness difference, the objects of the invention are more readily attained. The upper limit of the hardness difference is usually up to 60 units, especially up to 50 units in Shore D hardness. If the Shore D hardness of the outer core is equal to or lower than the Shore D hardness of the center core, then the objects of the invention are not attainable.

While a particular hardness of the outer core may be adjusted in accordance with the hardness of the center core, it is recommended that the Shore D hardness of the outer core is at least 55, preferably at least 56, more preferably at least 57 and up to 85, preferably up to 84, more preferably up to 83. An outer core with a lower Shore D hardness may lead to low resilience and less agreeable sensory characteristics, whereas an outer core with a higher Shore D hardness may lead to less durability and a hard feel.

It is recommended that the outer core have a radial thickness or gage of up to 10 mm, preferably up to 8 mm, more preferably up to 7 mm and at least 1 mm, preferably at least 1.3 mm, more preferably at least 1.5 mm. An outer core with a smaller gage may lead to poor durability whereas an outer core with a larger gage may lead to a hard feel. However, a particular gage of the outer core may be adjusted in accordance with the diameter of the center core. As long as the diameter of the solid core is within 27 mm, the outer core may be made relatively thick when the center core is small, and inversely, the outer core may be made relatively thin when the center core is large. By adjusting the gage of the outer core in this way, the problem of a hard feel resulting from a too thick outer core in the prior art can be avoided. Further adjustment can be made by lowering the Shore D hardness of the center core and in accordance with the material and hardness of the intermediate layer surrounding the outer core.

The solid core composed of a center core enclosed within an outer core as described above has a relatively small diameter of up to 27 mm, preferably up to 26 mm, and especially up to 25 mm. The lower limit is preferably 5 mm, more preferably 7 mm, and especially 8 mm. A solid core having a too small diameter may be ineffective whereas a solid core having a too large diameter falls within the concept of the prior art, leading to a hard feel, unsatisfactory click and less durability.

In the golf ball of the invention, an intermediate layer of one or more layers is formed on the surface of the outer core. The intermediate layer may be formed of any resinous materials or rubber compositions as described above for the center core and the outer core, preferably resinous materials. The intermediate layer closely enclosing the outer core (referred to as first intermediate layer) is preferably formed of the above-mentioned resinous materials. Included are polyamide resins, ionomer resins, polyester resins, polycarbonate resins, polyarylate resins, ABS resins, and mixtures thereof. These resins are commercially available under the trade name of Surlyn (ionomer resins) from E. I. DuPont, Himilan (ionomer resins) from Dupont-Mitsui Polychemical Co., Ltd., Hytrel (polyester resins) from Dupont-Toray Co., Ltd., Rilsan BMNO (polyamide resins) from Dupont-Toray Co., Ltd., U Polymer (polyarylate resins) from Unitika, Ltd., UBE Nylon (polyamide resins) from Ube Kosan Co., Ltd., and Pandex (polyurethane resins) from Dai-Nippon Ink & Chemicals Co., Ltd. As compared with rubber compositions enclosing the hard outer core, the use of resinous materials is effective for minimizing the cracking at the interface and maintaining durability. On use of these resinous materials, the molding processes described for the outer core are employable.

In order to effectively achieve the objects of the invention, the intermediate layer preferably includes at least one layer having a lower hardness than the outer core. Typically the first intermediate layer is the layer having a lower hardness than the outer core. Where the intermediate layer consists of a plurality of layers, it is preferred that all the layers be softer than the outer core. More particularly, the first intermediate layer closely enclosing the outer core preferably has a Shore D hardness which is at least 5 units, more preferably at least 7 units lower than the Shore D hardness of the outer core. Differently stated, the outer core is at least 5 units, more preferably at least 7 units harder than the first intermediate layer. The maximum difference in hardness between the outer core and the first intermediate layer is preferably 65, and more preferably 60. Further preferably the first intermediate layer is harder than the center core because not only a soft feel is obtainable, but agreeable sensory characteristics and better durability are also achievable. An appropriate hardness difference between the first intermediate layer and the center core is at least 2 units, more preferably at least 3 units, especially at least 5 units, and up to 45 units, especially up to 40 units, in Shore D hardness.

Specifically, the first intermediate layer may have a Shore D hardness of at least 10, especially at least 15 and up to 80, especially up to 70. Where the intermediate layer consists of a plurality of layers, the layers other than the first intermediate layer may have a Shore D hardness in the same range as above.

The solid core enclosed with the intermediate layer generally has an outer diameter of at least 36 mm, preferably at least 37.5 mm and up to 41.5 mm, preferably up to 39.5 mm.

The golf ball of the invention is made by forming a cover around the intermediate layer. The cover may be made of any well-known cover stock material. Illustrative are ionomer resins, thermoplastic polyurethane, polyamide, and polyester elastomers, and balata rubber. The cover may be formed by conventional injection molding and other processes.

Preferably the cover has a thickness of at least 0.5 mm, especially at least 0.8 mm and up to 3.0 mm, especially up to 2.5 mm. It is recommended that the cover have a Shore D hardness of at least 40, preferably at least 50 and up to 70, preferably up to 65. A cover with a lower hardness may lead to a resilience loss whereas a cover with a higher hardness may lead to a durability loss. It is recommended that the cover have a specific gravity of 0.9 to 1.4.

As in conventional golf balls, the golf ball of the invention has 300 to 600 dimples formed on the surface of the cover and distributed in a well-known arrangement.

The golf ball of the invention should be formed so as to have a diameter and weight which conform with the Rules of Golf. Specifically, the ball may have a diameter of not less than 42.65 mm, especially not less than 42.67 mm and not greater than 42.75 mm, and a weight of not greater than 45.93 g, especially not greater than 45.90 g and not less than 45.10 g.

EXAMPLE

Examples of the invention and comparative examples are given below by way of illustration, and are not intended to limit the invention.

Examples 1–4 and Comparative Examples 1–3

In each example, a center core was produced using the center core-forming composition of the formulation shown in Table 1. More particularly, resin compositions were injection molded in Examples 1 to 3 and Comparative Example 3. Rubber compositions were molded and vulcanized in Example 4 and Comparative Examples 1 and 2.

Next, an outer core-forming thermoplastic resin composition of the formulation shown in the table was injection molded around the center core in each example excluding Comparative Examples 2 and 3, to form an outer core, yielding a solid core having the center core enclosed with the outer core.

In each of Examples 1 to 4, a first intermediate layer-forming thermoplastic resin composition of the formulation shown in the table was injection molded around the solid core to form a first intermediate layer. In Example 2 only, a second intermediate layer was formed around the first intermediate layer by injection molding a second intermediate layer-forming thermoplastic resin composition of the formulation shown in the table. There was obtained a sphere having the solid core enclosed with an intermediate layer of two-layer structure.

In each of Comparative Examples 1 to 3, a first intermediate layer-forming rubber composition of the formulation shown in the table was worked in a roll mill and subjected to primary vulcanization (semi-vulcanization) at 130° C. for 10 minutes to form a pair of hemispherical cups. The pair of cups was closed over the solid core (center core+outer core) in Comparative Example 1 or directly over the center core in Comparative Examples 2 and 3, following which the cups were subjected to secondary vulcanization (complete vulcanization) at 155° C. for 20 minutes to give a sphere having the first intermediate layer.

Around the sphere having the intermediate layer formed, a cover-forming material of the formulation shown in the table was injection molded to form a cover. In this way, golf balls having dimples of the same shape, arrangement and number were produced.

Among the ingredients shown in the table, the trade names have the following meaning.

Hytrel: thermoplastic polyester elastomers manufactured by Dupont-Toray Co., Ltd.

Rilsan BMNO: thermoplastic polyamide elastomer manufactured by Toray Industries, Inc.)

Himilan: ionomer resins manufactured by DuPont-Mitsui Polychemical Co., Ltd.

Surlyn: ionomer resins manufactured by E. I. DuPont de Nemours and Co.

Pandex: thermoplastic polyurethane elastomers manufactured by Dai-Nippon Ink & Chemicals Co., Ltd.

The resulting golf balls were evaluated for durability, flight performance and sensory characteristics as described below. The results are presented in Table 1.

Durability

The ball at a randomly selected point was consecutively struck with a club. The number of strikes was counted until the ball was cracked. The number of strikes on the ball of Example 1 was acceptable. When the number of strikes was at least 10% smaller than Example 1, that ball was rated "Poor."

Flight Performance

Using a swing robot (Miyamae K.K.) equipped with a driver, the ball was hit at a head speed of 40 m/s (HS40). A carry and total distance were measured.

Sensory Characteristics when Hit

A sensory test was made by five professional golfers and five top amateur golfers who actually hit the ball. The ball was rated for feel by examining whether it was felt soft to the hands and for click by examining whether it sounded agreeable. The ball was rated "Poor (Hard)" when the results were inferior, "Fair" when the results were relatively inferior, and "Good (Soft)" when the results were superior.

TABLE 1

| Ingredients (pbw) | | | E1 | E2 | E3 | E4 | CE1 | CE2 | CE3 |
|---|---|---|---|---|---|---|---|---|---|
| Center core | Formulation | Hytrel 3078 | | | 100 | | | | |
| | | Hytrel 3548 | 100 | | | | | | |
| | | Hytrel 4047 | | 100 | | | | | |
| | | Rilsan BMNO | | | | | | | 100 |
| | | cis-1,4-polybutadiene | | | | 100 | 100 | 100 | |
| | | Zinc oxide | | | | 5 | 5 | 5 | |
| | | Zinc diacrylate | | | | 5 | 23 | 28 | |
| | | Dicumyl peroxide | | | | 1.2 | 1.2 | 1.2 | |
| | | Barium sulfate | 5 | | | 37 | 32 | 16 | 40 |
| | Parameters | Diameter (mm) | 15 | 18 | 24 | 11 | 15 | 32 | 25 |
| | | Weight (g) | 2.0 | 3.4 | 8.3 | 0.8 | 2.2 | 20.2 | 10.9 |
| | | Shore D hardness (ASTM D-2240) | 35 | 40 | 30 | 33 | 50 | 45 | 80 |
| Outer core | Formulation | Himilan AM7318 | 50 | | | 50 | | | |
| | | Himilan AM7317 | 50 | | | 50 | | | |
| | | Himilan 1706 | | | 50 | | 50 | | |
| | | Himilan 1605 | | | 50 | | 50 | | |
| | | Himilan 1650 | | 50 | | | | | |
| | | Surlyn 8120 | | 50 | | | | | |
| | | Barium sulfate | 10 | 5 | 5 | 10 | | | |
| | Parameters | Diameter (mm) | 20 | 24 | 27 | 26 | 30 | | |
| | | Weight (g) | 4.5 | 7.6 | 11.4 | 9.5 | 14.4 | | |
| | | Gage (mm) | 2.5 | 3.0 | 1.5 | 7.5 | 7.5 | | |
| | | Shore D hardness (ASTM D-2240) | 69 | 58 | 63 | 69 | 63 | | |
| Hardness difference (outer core - center core) | | | 34 | 18 | 33 | 36 | 13 | | |
| 1st intermediate layer | Formulation | Pandex T-8195 | 100 | | | | | | |
| | | Hytrel 4767 | | 100 | | 100 | | | |
| | | Surlyn 8120 | | | 50 | | | | |
| | | Himilan 1650 | | | 50 | | | | |
| | | cis-1,4-polybutadiene | | | | | 100 | 100 | 100 |
| | | Zinc oxide | | | | | 5 | 5 | 5 |
| | | Zinc diacrylate | | | | | 23 | 30 | 37 |
| | | Dicumyl peroxide | | | | | 1.2 | 1.2 | 1.2 |
| | | Barium sulfate | 4 | 3 | 33 | 7 | 48 | 14 | 5 |
| | Parameters | Diameter (mm) | 38.9 | 36.7 | 38.9 | 38.7 | 38.1 | 38.7 | 38.7 |
| | | Weight (g) | 35.7 | 30.5 | 35.7 | 35.2 | 33.9 | 35.2 | 35.2 |
| | | Shore D hardness (ASTM D-2240) | 49 | 48 | 56 | 47 | 50 | 54 | 60 |
| Hardness difference (outer core - 1st intermediate layer) | | | 20 | 10 | 7 | 22 | 13 | — | — |
| Hardness difference (1st intermediate layer - center core) | | | 14 | 8 | 26 | 14 | 0 | 9 | −20 |
| 2nd intermediate layer | Formulation | Himilan 1605 | | 50 | | | | | |
| | | Himilan 1706 | | 50 | | | | | |
| | | Barium sulfate | | 10 | | | | | |
| | Parameters | Diameter (mm) | | 39.7 | | | | | |
| | | Weight (g) | | 37.5 | | | | | |
| | | Specific gravity | | 1.023 | | | | | |
| | | Shore D hardness (ASTM D-2240) | | 63 | | | | | |
| Cover | Formulation | Himilan 1605 | 50 | | 50 | 50 | 50 | 50 | 50 |
| | | Himilan 1706 | 50 | | 50 | 50 | 50 | 50 | 50 |
| | | Surlyn 8120 | | 50 | | | | | |
| | | Himilan 1650 | | 50 | | | | | |
| | Parameter | Gage (mm) | 1.9 | 1.5 | 1.9 | 2.0 | 2.3 | 2.0 | 2.0 |
| Ball | Parameters | Diameter (mm) | 42.7 | 42.7 | 42.7 | 42.7 | 42.7 | 42.7 | 42.7 |
| | | Weight (g) | 45.3 | 45.3 | 45.3 | 45.3 | 45.3 | 45.3 | 45.3 |
| | Durability | | Good | Good | Good | Good | Poor | Poor | Poor |
| | HS40 | Carry (m) | 198.0 | 199.0 | 198.6 | 199.0 | 196.5 | 197.0 | 197.6 |
| | | Total (m) | 210.0 | 210.5 | 211.0 | 210.8 | 207.0 | 207.9 | 208.6 |
| | Sensory characteristics | Feel | Soft | Soft | Soft | Soft | Fair | Soft | Fair |
| | | Click | Good | Good | Good | Good | Fair | Poor | Fair |

Note that the diameter and weight in Parameters are those of an entire sphere having the designated layer formed.

There has been described a golf ball which is improved in sensory characteristics including feel and click when hit with a golf club, durability against strikes, and flight performance.

Japanese Patent Application No. 11-207332 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

What is claimed is:

1. A solid golf ball of multilayer construction of at least four layers, comprising a solid core consisting of a center core and an outer core around the center core, an intermediate layer of at least one layer enclosing the solid core, said intermediate layer closely enclosing the surface of said solid core and being formed of a resin base composition, and a cover enclosing the intermediate layer, wherein said outer core is formed of a thermoplastic resin base composition and has a Shore D hardness higher than said center core, and said solid core has a diameter of up to 27 mm, and said intermediate layer closely enclosing the surface of said solid core has a Shore D hardness which is at least 8 units higher than said center core.

2. The solid golf ball of claim 1 wherein the Shore D hardness of said outer core is from 55 to 85.

3. The solid golf ball of claim 1 wherein the Shore D hardness of said outer core is at least 5 units higher than the Shore D hardness of said center core.

4. The solid golf ball of claim 1 wherein at least one layer of said intermediate layer has a lower Shore D hardness than said outer core.

5. The solid golf ball of claim 1, wherein the diameter of the center core is from 3 mm to 25 mm.

6. The solid golf ball of claim 1, wherein the Shore D hardness of the center core is from 10 to 50.

7. The solid golf ball of claim 1, wherein the Shore D hardness of the outer core is higher than the Shore D hardness of the center core and the hardness difference is from 5 to 60.

8. The solid golf ball of claim 1, wherein the Shore D hardness of the outer core is higher than the Shore D hardness of the center core and the hardness difference is from 18 to 60.

9. The solid golf ball of claim 1, wherein the outer core has a gage of from 1 mm to 10 mm.

10. The solid golf ball of claim 1, wherein the solid core has a diameter of from 5 mm to 27 mm.

11. The solid golf ball of claim 1, wherein the cover has a Shore D hardness of up to 65.

12. The solid golf ball of claim 1, wherein the intermediate layer closely enclosing the surface of the solid core is formed of a resin base composition selected from polyamide resins, ionomer resins, polyester resins, polycarbonate resins, polyarylate resins, ABS resins, and mixtures thereof.

13. The solid golf ball of claim 1, wherein the center core is formed of a thermoplastic resin base composition.

14. The solid golf ball of claim 1, wherein the Shore D hardness difference between the intermediate layer closely enclosing the surface of the solid core and the center core is up to 45 units.

15. The solid golf ball of claim 1, wherein the Shore D hardness difference between the intermediate layer closely enclosing the surface of the solid core and the center core is up to 40 units.

16. The solid golf ball of claim 1, wherein the Shore D hardness of the outer core is higher than the Shore D hardness of the center core and the hardness difference is from 33 to 60.

17. The solid golf ball of claim 1, wherein the intermediate layer has two layers of a first intermediate layer and a second intermediate layer.

* * * * *